US007044776B2

(12) United States Patent
King, Jr. et al.

(10) Patent No.: US 7,044,776 B2
(45) Date of Patent: May 16, 2006

(54) WIRE CONNECTOR

(76) Inventors: Lloyd Herbert King, Jr., 394 Larimore Valley Dr., Chesterfield, MO (US) 63005; Michael Belgeri, 1007 Bridgeport, Ellisville, MO (US) 63011; James Keeven, 2641 Whitetail La., O'Fallon, MO (US) 63366; John Cain, 23 Dardenne Crossing, O'Fallon, MO (US) 63366; William Hiner, 8 Briarcastle Ct., O'Fallon, MO (US) 63366

( * ) Notice: Subject to any disclaimer, the term of this patent is extended or adjusted under 35 U.S.C. 154(b) by 0 days.

(21) Appl. No.: 10/724,980

(22) Filed: Dec. 2, 2003

(65) Prior Publication Data

US 2005/0118851 A1 Jun. 2, 2005

(51) Int. Cl.
*H01R 13/52* (2006.01)

(52) U.S. Cl. ..... 439/521; 439/797; 439/814

(58) Field of Classification Search ..... 174/76; 439/204, 521 I, 797, 810, 811, 814, 936
See application file for complete search history.

(56) References Cited

U.S. PATENT DOCUMENTS

| | | | | |
|---|---|---|---|---|
| 970,087 A | | 9/1910 | Murray | |
| 1,307,240 A | | 6/1919 | Christopher | |
| 1,352,034 A | | 9/1920 | Sherman | |
| 1,420,790 A | | 6/1922 | Varney | |
| 2,092,372 A | | 9/1937 | Geoller | 173/62 |
| 3,350,677 A | | 10/1967 | Daum | 339/149 |
| 3,551,876 A | | 12/1970 | Walter | 339/21 |
| 3,602,871 A | | 8/1971 | Newman | 339/22 B |
| 3,727,171 A | | 4/1973 | Coles et al. | 339/22 B |
| 3,879,575 A | * | 4/1975 | Dobbin et al. | 174/92 |
| 4,053,202 A | | 10/1977 | Norden | 339/272 |
| 4,196,652 A | | 4/1980 | Raskin | 339/246 |
| 4,425,017 A | | 1/1984 | Chan | 339/96 |
| 4,674,816 A | | 6/1987 | Frenznick et al. | 439/588 |
| 4,909,756 A | * | 3/1990 | Jervis | 439/521 |
| 4,910,867 A | | 3/1990 | Weigert | 29/839 |
| 5,061,193 A | | 10/1991 | Seaman | 439/76 |
| 5,198,619 A | * | 3/1993 | Baker | 174/74 A |
| 5,387,129 A | | 2/1995 | Hotea | 439/587 |
| 5,397,859 A | * | 3/1995 | Robertson et al. | 174/92 |
| 5,569,882 A | * | 10/1996 | Yokoyama et al. | 174/76 |
| 5,580,265 A | | 12/1996 | Koblitz et al. | 439/276 |
| 5,594,210 A | * | 1/1997 | Yabe | 174/76 |
| 5,637,007 A | | 6/1997 | Suzuki et al. | 439/276 |
| 5,727,314 A | | 3/1998 | Ashcracft | 29/884 |
| 5,962,811 A | | 10/1999 | Rodrigues et al. | 174/76 |
| 6,025,559 A | | 2/2000 | Simmons | 174/87 |
| 6,051,791 A | | 4/2000 | King | 174/87 |
| 6,132,251 A | | 10/2000 | Onoda | 439/587 |
| 6,174,177 B1 | | 1/2001 | Auclair | 439/100 |
| 6,196,863 B1 | | 3/2001 | Schwant | 439/417 |

(Continued)

FOREIGN PATENT DOCUMENTS

FR 2535911 5/1984

(Continued)

*Primary Examiner*—Thanh-Tam Le
(74) *Attorney, Agent, or Firm*—Jacobson & Johnson

(57) ABSTRACT

An open-face electrical wire connector for forming an electrical connection to a wire connector lug wherein the wire connector lug, which is free of any sealant, is located in a portion of a housing that can be brought into engagement with another portion of a housing, which carries a sealant, to cause the sealant to flow around the wire connector lug and the electrical connection therein for on-the-go formation of a sealant covered electrical connection.

43 Claims, 3 Drawing Sheets

U.S. PATENT DOCUMENTS 6,224,419 B1 5/2001 Tucker et al. ..... 439/521
6,225,562 B1 5/2001 Fujishita et al. ..... 174/76
6,242,700 B1 6/2001 Smith ..... 174/77
6,284,976 B1 9/2001 Pulido et al. ..... 174/77 R
6,300,572 B1 10/2001 McKay ..... 174/74 R
6,435,910 B1 8/2002 Blasko et al. ..... 439/587

FOREIGN PATENT DOCUMENTS

JP 6231827 A2 8/1994
JP 9198987 A2 7/1997

* cited by examiner

WIRE CONNECTOR

FIELD OF THE INVENTION

This invention relates generally to wire connectors and, more specifically, to an open-face wire connector for on-the-go formation of a sealant covered electrical junction.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

One of the ways of formation of on-the-go sealant covered electrical connection in twist on wire connectors is disclosed in King U.S. Pat. Nos. 5,151,239; 5,113,037; 5,023,402 and Re 37,340 which show a twist on wire connector that allows on-the-go formation of a sealant covered electrical connection in the presence of a sealant.

The twist-on type of wire connector is well suited for joining two or more wires into an electrical connection with each other. Other applications such as the formation of connection to branch lines or the formation of electrical connections to other types of lugs generally require that the connection be made to the wire connector lug and the sealant is then poured or injected into the housing to encapsulate the electrical connections therein.

The Simmons U.S. Pat. No. 6,025,559 discloses a tubular housing having a twist-on wire connector where the wires are twisted into a coil and the wires and the wire holder are forced into a sealant located at the end of the tubular housing.

Still another embodiment of a tubular is shown in King U.S. Pat. No. 6,051,791 wherein a two part connector containing a connector is made in a shoe and the shoe with the electrical connector is forced into a tubular member containing a sealant.

In contrast, the embodiments of the present invention include an open-face connector that permits on-the-go formation of an electrical connection on a connector lug, which is free of any sealant and is located in one part of a housing, and then once the electrical connection is formed to the electrical lug the user brings another part of the housing, which is carrying a sealant, into engagement with the part of the housing carrying the electrical lug to cause the sealant to flow around the wire connector lug and the electrical connections therein.

SUMMARY OF THE INVENTION

An open-face electrical wire connector for forming an electrical connection to a wire connector lug wherein the wire connector lug, which is free of any sealant, is located in a portion of a housing that can be brought into engagement with another portion of a housing, which carries a sealant, to cause the sealant to flow around the wire connector lug and the electrical connection therein for on-the-go formation of a sealant covered electrical connection.

DESCRIPTION OF THE PREFERRED EMBODIMENT

Figure 1:
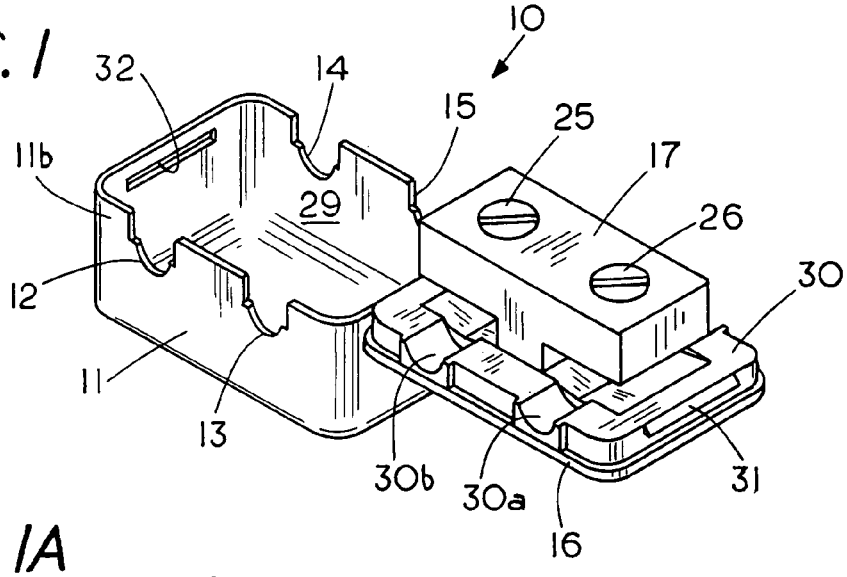
FIG. 1 is a perspective view of the on-the-go sealable wire connector.

FIG. 1 is a perspective view of an open-face electrical connector 10 that permits on-the-go sealablity of an electrical junction after an electrical connection has been formed. The open-face wire connector 10, which is a clam shell type wire connector, is shown in the empty or non-sealant carrying condition. The wire connector 10 including a first open top housing 11 for receiving and holding a sealant and a second housing or cover 16 that contains no sealant. Cover 16 and housing 11 are hinged to each other for forming an enclosure when the cover 16 and housing are mated to each other. In the embodiment shown hinge 11*a* includes a bias to hold the cover in a laterally extended condition from the housing so as to make the wire connector lug 17 readily accessible for forming an electrical connection. Housing 11 and housing 16 are formed of an electrical insulating material such as a polymer plastic. Housing 11 includes an open top chamber or open top sealant reservoir 29, which is surrounded by a sidewall 11*b*. Sidewall 11*b* includes a set of side wire access openings or wire relief areas 12, 13, 14 and 15 for extending wires into and out of the chamber 29 in housing 11.

Open face connector 10 can be used in various modes. If there is no sealant present in chamber 29 the connector 10 can be used to form a protective housing around an electrical junction by closing cover 16 on housing 11. On the other hand if a user wants to use a sealant on certain connections but not on other types of connections the user can place the sealant in those open face connectors that require sealant and leave the other connections without sealant.

The cover 16 includes a support member 30 holding a wire connection member or wire connector lug 17 therein. Cover 16 has a mating shape with housing 11 so that when the cover 16 and housing 11 are brought into engagement with each other they form an enclosure to inhibit and maintain the sealant in chamber 29. In the embodiment shown the cover 16 and housing 11 are made from a polymer plastic with a living hinge 11*a* (see FIG. 2) therebetween to allow for maintaining the cover 16 and housing 11 proximate each other when the wire connector 10 is in the open condition. In addition, the hinge 11*a* allows one to rotate the cover 180 degrees thereabouts to bring the cover into mated engagement with the housing 11. In the normal condition the cover 16 is held in an open and extended condition so as not to contact the sealant that is placed in housing chamber 29.

Located on cover 16 is the wire connector lug 17 which is held in an extended position so that a user can have free access to the screw fasteners 25 and 26. That is, electrical connections can be made to lug 17 as if lug 17 where independent of cover 16. A further feature of the invention is that if the connector lug 17 is frictionally maintained in cover member 30 the connector lug 17 can be removed for independent attachment of a wire or wires thereto. Once connected the user can then place the connector lug in the cover member 30 and close the cover 16 to bring the connector lug into the sealant.

Figure 1A:
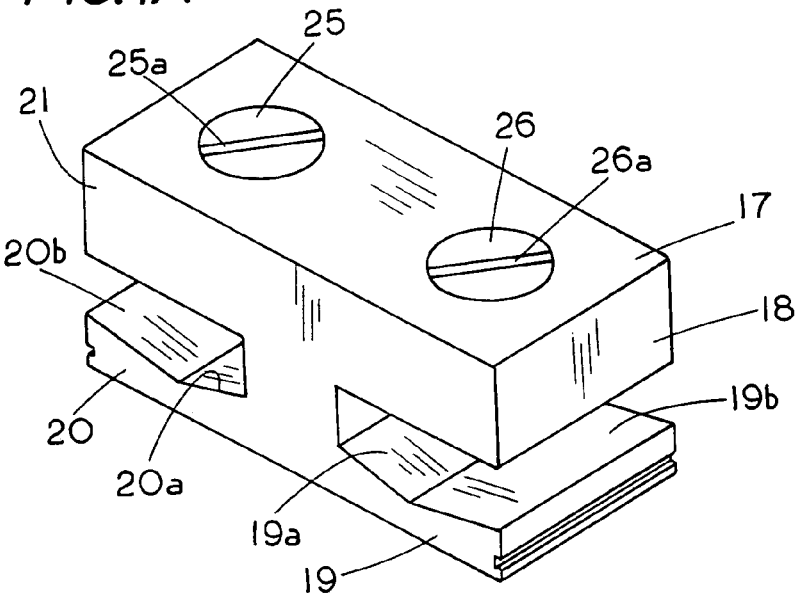
FIG. 1A is a perspective view of a wire connector lug for inclusion in the wire connector of FIG. 1.

FIG. 1A shows that wire connector lug or wire connection member 17, which comprises an I shaped wire connecting lug, has been removed from support member 30. In the embodiment shown the sides of wire connector lug 17 frictionally engage support member 30 to maintain the wire connector lug 17 in member 30 to allow for the removal if desired. Wire connection lug 17 includes a first open jaw 18 and a second open jaw 19 at one end for laterally inserting an electrical wire therebetween. Jaw 19 includes a V shaped surface 19*a* and 19*b* forming a wire locator for centering an electrical wire thereon. A threaded member 26, such as a slot headed set screw, is retained in rotational engagement with jaw 18 by a female thread located in jaw 18 (not shown). A slot 26*a* allows one to rotate the threaded member 26 to bring a connecting end of threaded member 26 into pressure contact with an electrical wire therein to thereby bring the wire connection lug into electrical contact therewith. The opposite end of wire connector lug 17 is identical and includes an upper jaw 21 with a threaded member 25 having a slotted head 25*a* for rotating threaded member 25. Similarly, located on lower jaw 20 is a V shaped wire centering surface comprising flats 20*a* and 20*b*.

In the embodiment shown the electrical connector lug comprises an electrical conducting material such as metal and includes a base section that frictionally fits into the support 30 to hold the wire connection lug in position. The outer housing 11 and 16 preferably comprise an electrically insulating material to thereby electrically isolate the wire connection therein. While a wire connection lug for forming a branch attachment to a main line without cutting the main line is shown the present invention is usable with other types of electrical connector lugs.

Figure 1B:
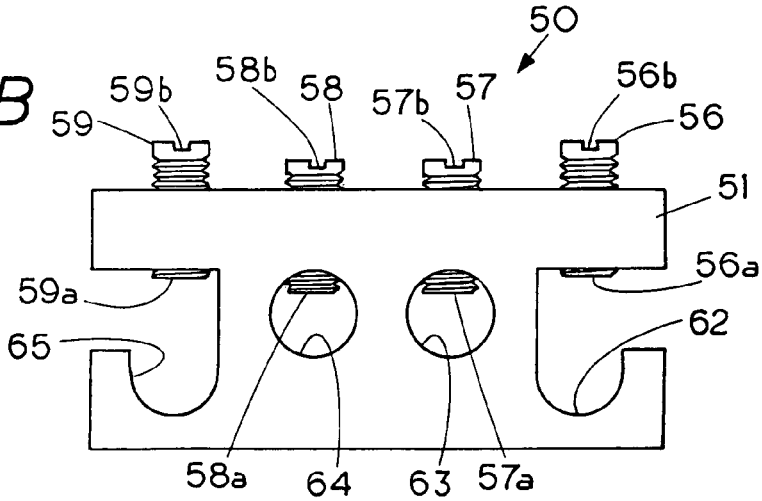
FIG. 1B is a perspective view of a multiple channel wire connector lug for inclusion in the wire connector of FIG. 1.

FIG. 1B shows a multiple wire connector lug 50 comprising a metal or electrically conducting block 51 having a J shaped wire receiver 65 on one end and a J-shaped wire receiver 62 on the opposite end. A screw 56 is rotatable mounted in a set of female threads (not shown) in lug 51. A slot 56*b* permits one to rotate screw 56 and bring screw end 56*a* into pressure engagement with a wire or wires that are positioned in wire receiver 52 to thereby hold the wire or wires in position and electrical contact. Lug 50 also contains female threads (not shown) for screws 57, 58 and 59. An identical wire receiver 65 is located on the opposite end and also includes a screw 59 having a slot 59*b* for bringing screw end 59*a* into pressure engagement with a wire or wires located in wire receiver 65 to thereby form an electrical connection. The wire connector lug 50 also contains through cylindrical shaped wire receivers 63 and 64 for forming electrical connections therewith. That is, a screw 58 having a slot 58*b* allows one to rotate screw 58 to bring end 58*a* into pressure contact with a wire or wires in wire receiver 64. Similarly, a screw 57 having a slot 57*b* allows one to rotate screw 57 to bring screw end 57*a* into pressure contact with a wire or wires located in wire receiver 63. While the invention is shown with the sealant in the portion of the housing that is separate from the connector it is envisioned that a smaller amount of sealant can be placed directly in the wire receivers 62, 63, 64 and 65. This is particularly useful when one wants to cover only the exposed end of a wire.

Figure 2:
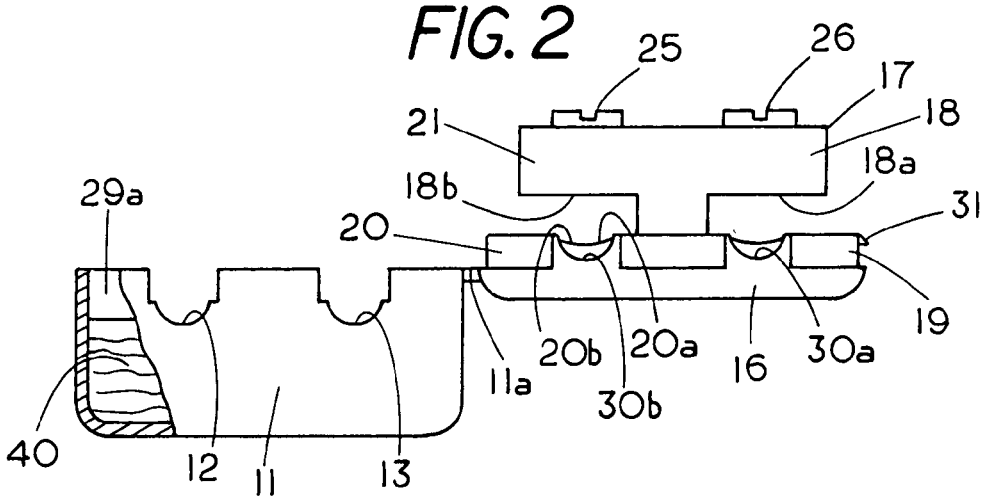
FIG. 2 is a side view of the wire connector of FIG. 1.

FIG. 2 shows a side view of the electrical connector of FIG. 1 in the open-face condition and with the chamber 29 partially filled with a sealant 40. In the preferred embodiment the sealant 40 comprises a viscous sealant such as silicone or the like which is retained in the housing if the housing 11 is tipped during handling or forming the electrical connection to the wire connector lug 17. Other types of sealant, such as epoxy sealants, could also be used in the present invention. The wire connector lug 17 is spaced from the sealant containing chamber 29 so as to allow a user to first form an electrical connection before bringing the sealant into contact with the connector lug. The rotatable screw fasteners 25 and 26 are located in a retracted condition so that a first electrical wire can be extended between the jaws 18 and 19 and a second electrical wire can be extended between the jaws 20 and 21. In the embodiment shown, the cover 16 includes a wire relief area 30*b* for fitting around an exterior circumferential portion of a first wire passing therein. Similarly, shown, the cover 16 includes a wire relief area 30*a* for fitting around an exterior circumferential portion of a second wire passing therein. Preferably wire relief areas 30*a* in cover 16 and wire relief area 12 in housing 11 coact with each other so that when closed they can each encompass about half a cylindrical wire. Similarly, wire relief area 30*b* and 13 coact with each other to each encompass about half a cylindrical wire extending through the sidewall of the wire connector 10.

Figure 7:
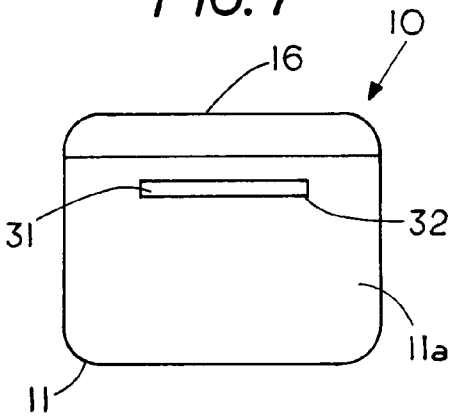
FIG. 7 is an end view of the wire connector housing showing the two housings in an engaged condition.

Housing 11 includes a latch member 32 comprising an elongated slot 32 (FIG. 7) which can form latching engagement with a further latch member comprising a lip 31, which is located on cover 16. When cover 16 is closed on top of housing 11, as shown in FIG. 7, the lip 31, which protrudes from the housing 11, engages the sidewall 11*a* to latch and cooperatively hold the wire connector in a closed condition.

FIG. 2 shows the sealant 40 having a volume that partially fills chamber 29 when the cover and wire connector lug are in the open condition. When the wire connector lug 17 and cover are brought into the closed condition there should be sufficient sealant in chamber 40 so that the sealant 40 is forced to flow around and encapsulate the electrical junctions therein as the free volume 29*a* of chamber 29 is reduced by the insertion of the wire connector lug therein. In one embodiment the free volume 29*a* of chamber 29, as illustrated in FIG. 2, is about equal to the volume of the wire connector lug and the wires inserted therein so as to force the sealant to flow around and encapsulates the electrical connection in the electrical connector lug 17 when the lug 17 is brought into the housing to thereby protect the electrical connections from adverse environmental conditions. In another embodiment the sealant can be positioned so that the wire connector lug is immersed in a reservoir of sealant therein.

Figure 3:
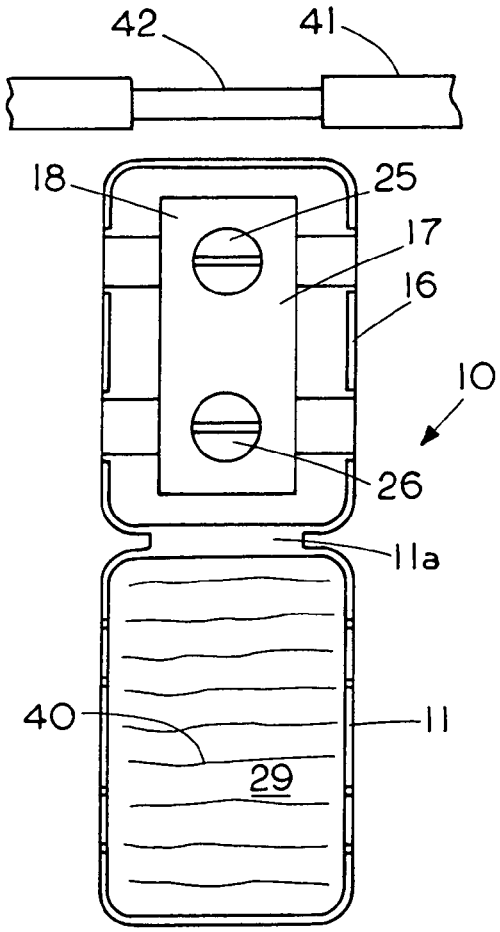
FIG. 3 is a top view of the wire connector of FIG. 1 in the open condition and a partially stripped electrical wire and a sealant in one part of the housing.

FIG. 3 shows the on-the-go wire connector 10 and an electrical wire 41 that has been partially stripped to expose the conducting member 42. In the embodiment shown the electrical wire comprises an uncut electrical wire that a branch connection is to be formed thereto without having to sever the main line. That is, one wishes to connect a branch line to conductor 42 without having to sever wire 42.

Figure 4:
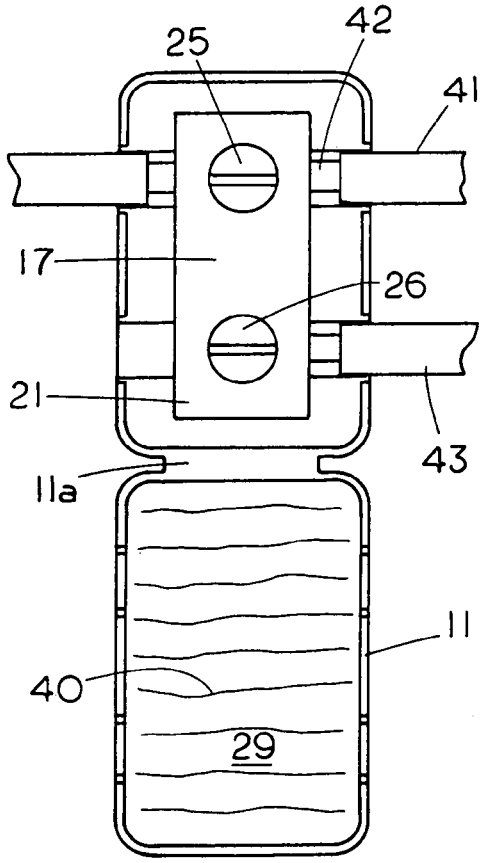
FIG. 4 is a top view of the wire connector of FIG. 3 in the open condition with electrical wires connected thereto.

With the wire connector 10 in the open condition and the chamber 29 contains a sealant therein one can form an electrical connection by placing the stripped wire 42 between upper jaw 18 and lower jaw 19 (see FIG. 3 and FIG. 4) and then rotating the threaded member 26 to bring the wire 42 into electrical contact. Once in electrical contact a branch line such as electrical wire 43 can be connected to the other end of lug by placing the electrical wire 43 between upper jaw 21 and lower jaw 20.

Thus the method of forming a branch attachment to an electrical wire without having to cut the electrical wire comprising the steps of: 1. forming a first housing 11 having a chamber 29 therein and placing a sealant 40 in the first housing. 2. forming a second housing with an electrical connection member 17 thereon. 3. Inserting an electrical wire 41 into the electrical connection member 17. 4. Placing the first housing 11 and the second housing 16 in engagement to cause the sealant 40 in the first housing 11 to flow around an electrical junction in the electrical connection member 17.

By placing a sufficient amount of a viscous sealant in the first housing 11 it allows one to bring the second housing 16 into engagement and causes the sealant 40 in the second housing to flow around the wire connection member 17 to form a waterproof electrical connection therein. At the same time the connection to the electrical connector lug is made when the connector lug is free of any sealant.

When the wire connector lug has open jaws the wire connector 10 can be used to form a branch line to the main line without severing the main line by the step of stripping a portion of an electrical wire 41 and inserting the stripped portion 42 into the wire connection member 17 and between the open jaws of the wire connector 17.

Figure 5:
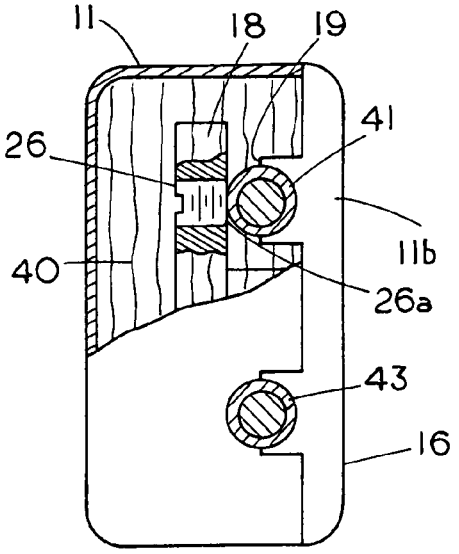
FIG. 5 is a partial side section view showing the wire connecting junction encapsulated in the sealant.

FIG. 5 is a partial sectional view showing a side view of the wire connector 10 revealing a partial cutaway of jaw 18 showing the threaded member 26 having an end 26*a* in pressure contact with electrical wire 41 located in the wire connector 10. As can be seen in FIG. 5 the volume of sealant 40 is sufficient so that when the cover 16 and housing 11 are brought together the lug and wires force the sealant to flow around the electrical junction between the opposing jaws 18 and 19 of lug 17.

Figure 6:
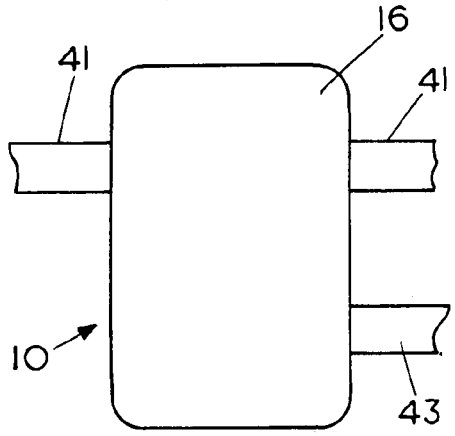
FIG. 6 is a top view of the wire connector of FIG. 3 in the closed condition.

FIG. 6 shows the wire connector 10 in the closed condition with the main line electrical wire 41 extending from opposite sides of wire connector 10. The branch line 43 which is connected to the main line 41 within wire connector 10 extends laterally outward from housing cover 16. As can be seen in FIG. 6 the present wire connector allows the wire to remain in a straight condition since the wire 41 need not be bent to form the electrical connection.

FIG. 7 is an end view of the on-the-go wire connector 10 in the closed condition with the cover 16 in a mated condition with housing 11 through engagement of lip 31 with slot 32 in housing sidewall 11*a*.

Figure 8:
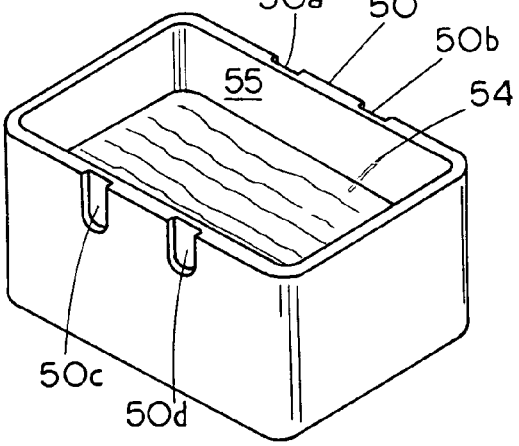
FIG. 8 is a perspective view of an alternate embodiment of the invention.

FIG. 8 is a perspective view of a wire connector housing 50 having a chamber 55 for carrying a sealant therein. Housing 50 contains a set of U-shaped knockouts 50*a*, 50*b*, 50*c* and 50*d* which comprise weakened sections of the sidewalls of housing. The knockouts can be removed with a pliers or screwdriver to provide an entry region for the wires into and out of housing 50. In an alternate embodiment the knockouts could be replaced with a grommet like member to engage the wires as the wires extend into and through housing 50.

Figure 9:
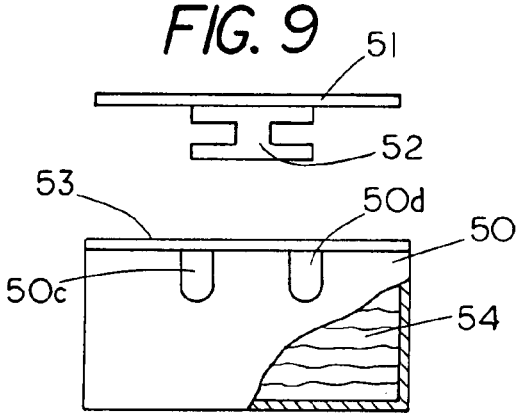
FIG. 9 is a elevation view of the embodiment of FIG. 8 with a separate cover for attachment to the housing.

FIG. 9 shows an exploded view of the two-part connector with a first member 51 carrying a wire connector 52 thereon. Located below first member 51 is the second member 50 which comprises housing 50. A portion of housing 50 has been cutaway to reveal the sealant 54 contained in chamber 55. In the embodiment shown, a thin film of a penetrateable material 53 extends across the top of housing 50 to retain the sealant in the housing 50 while the housing is in the preuse condition. Material 53 is a punctureable layer of material that can either be torn away from the housing to reveal the chamber with the sealant 54 or can be punctured by inserting the wire connector 52 through the film 53 and into the housing 50. In either case the material 53 can provide a barrier to prevent escape of sealant and when coupled with a housing with knockouts comprises a sealed container that can store the sealant in a ready to use but non-spillable condition.

The invention claimed is:

1. A open-face electrical connector comprising:

a housing, said housing having a chamber therein;

a sealant located in said chamber;

a wire connector lug having a female thread, said wire connector lug removably held in said housing and having an open jaw for lateral insertion of an electrical wire therein;

a threaded member having a wire engaging end for engaging said female thread;

a cover;

a hinge, said hinge holding said cover in a spaced condition from said housing;

said cover and said housing forming an enclosure so that when said cover is placed on said housing the sealant located in said housing is forced around the wire connector lug to form a sealant covered electrical junction in the wire connector lug.

2. The open-face electrical connector of claim 1 wherein the hinge comprises a living hinge connecting said housing and said cover.

3. The open-face electrical connector of claim 1 wherein the wire connector lug has an I shape with an open jaw at each end.

4. The open-face electrical connector of claim 1 wherein the cover and said housing comprise electrically insulating material.

5. The open-face electrical connector of claim 1 wherein the wire connector lug comprises an electrical conductor.

6. The open-face electrical connector of claim 1 wherein the wire connector lug has two open jaws for lateral wire insertion therein.

7. The open-face electrical connector of claim 1 wherein the housing and the cover comprise a polymer plastic.

8. The open-face electrical connector of claim 1 wherein the sealant comprises a viscous sealant that is retainable in the chamber of the housing.

9. The open-face electrical connector of claim 8 wherein the sealant comprise silicone.

10. The open-face electrical connector of claim 1 wherein the sealant in said chamber comprises an amount sufficient to fill the chamber in the housing when the wire connector lug is positioned in the chamber.

11. The open-face electrical connector of claim 1 wherein the wire connector lug is frictionally held in the cover.

12. The open-face electrical connector of claim 1 wherein the housing includes a wire access opening on each side of the housing.

13. The open-face electrical connector of claim 1 wherein the housing includes a first latch member and the cover includes a second latch member that cooperatively hold the cover in a closed condition.

14. The open-face electrical connector of claim 13 wherein one of the latch members comprises an elongated opening and the other latch member comprise a lip for insertion into the elongated opening.

15. The wire connector of claim 1 wherein a volume of sealant in the chamber is sufficient so that positioning the wire connector lug in the chamber causes an encapsulation of the wire connector lug.

16. The wire connector of claim 1 wherein the cover is connected to said housing by the hinge.

17. The wire connector of claim 1 wherein a portion of the chamber is free of sealant.

18. The wire connector of claim 17 wherein a volume of the portion of the chamber that is free of sealant and a volume of the wire connector lug are such that forcing the wire connector lug into the volume of sealant causes the sealant to flow around the wire connector lug and encapsulate the electrical connection without the sealant being forced out of the housing.

19. The wire connector of claim 18 wherein the wire connector lug comprises an I-shaped connector with a set of jaws on each end.

20. The wire connector of claim 19 wherein at least one of the set of jaws includes a wire locator.

21. The wire connector of claim 20 wherein the cover includes a latch for securing said cover to said housing.

22. The wire connector of claim 21 wherein the hinge includes a bias to hold the cover in a laterally extended condition from the housing.

23. The wire connector of claim 22 wherein the housing includes a wire relief area to permit a wire to extend through a housing side wall.

24. The wire connector of claim 1 wherein said wire connector lug includes at least one J-shaped wire receiver.

25. The wire connector of claim 1 wherein said wire connector lug includes at least three wire receivers.

26. The wire connector of claim 1 wherein the wire connector lug includes a J-shaped wire receiver at opposite ends to permit joining an uncut wire thereto.

27. The wire connector of claim 1 wherein the wire connector lug includes a cylindrical shaped wire receiver.

28. The wire connector of claim 1 wherein the housing contains a sealant and a film extends across the housing to retain the sealant in the housing.

29. The wire connector of claim 1 wherein the housing contains a set of knockouts to provide a wire passage to the chamber in the housing.

30. The wire connector of claim 1 wherein the housing and the cover comprises separate parts.

31. An on-the-go sealable wire connector comprising:

a housing, said housing having a chamber therein;

a sealant located in said chamber;

a wire connection member including a wire connector lug having a threaded member for rotatingly engagement with an electrical wire therein, said wire connection member maintainable in a sealant free state when said housing is in an open condition and said wire connector connection member is in an unconnected condition, said wire connection member displaceable into the chamber;

a cover, said cover carrying said wire connection member, said cover and said housing forming an enclosure so that when said cover is placed on said housing the sealant located in the chamber flows around the wire connection member to form a sealant covered electrical junction in the wire connection member to thereby bring the wire connection member from a sealant free state to said sealant covered state.

32. The on-the-go sealable wire connector of claim 31 wherein the cover is hingedly attached to said housing.

33. The on-the-go sealable wire connector of claim 32 wherein the sealant is a viscous sealant.

34. The on-the-go sealable wire connector of claim 33 wherein the enclosure includes opening for extending electrical wires therethrough.

35. The on-the-go sealable wire connector of claim 34 wherein the housing comprises an electrically insulating material.

36. The on-the-go sealable wire connector of claim 35 wherein the housing and the cover include a latch for on-the-go securing the cover to the housing to thereby maintain the sealant therein from coming into contact with an external connector environment.

37. The on-the-go sealable wire connector an electrically insulated material forming a housing, said housing having a chamber therein;

a viscous sealant located in said chamber;

a wire connection member including, a wire connector lug having a threaded member to bring said wire connector lug in electrical engagement with an electrical wire therein, said wire connection member maintainable in a sealant free state when said housing is in an open condition and said wire connector lug is in an unconnected condition, said wire connector lug displaceable into the chamber;

a cover hingedly attached to said housing, said cover carrying said wire connection member, said cover and said housing forming an enclosure with openings for extending electrical wires therethrough so that when said cover is placed on said housing the sealant located in the chamber flows around the wire connector lug to form a sealant covered electrical junction in the wire connection member to thereby bring the wire connector lug from a sealant free state to said sealant covered state; and a latch for on-the-go securing the cover to the housing to thereby maintain the sealant therein from coming into contact with an external connector environment.

38. The on-the-go sealable wire connector of claim 37 wherein the wire connector lug has at least one open jaw for lateral insertion of an uncut electrical wire therein.

39. The method of forming a branch attachment to an electrical wire without having to cut the electrical wire comprising the steps of:

forming a first housing having a chamber therein;

placing a sealant in the first housing;

forming a second housing, said second housing having an electrical connection member thereon;

maintaining the electrical connection member free of sealant;

inserting an uncut electrical wire into the electrical connection member while maintaining the electrical connection member free of sealant;

securing the uncut electrical wire to the electrical connection member rotationally engaging a female thread in the electrical connection member to form an elec trical connection therebetween while the electrical connection member is free of sealant;

securing a further electrical wire to the electrical connection to form a branch attachment to the uncut electrical wire; and placing the first housing with the sealant therein and the second housing in engagement to cause the sealant in the first housing to flow around an electrical junction in the electrical connection member.

40. The method of claim 39 including the step of securing the electrical connection member to one of the housings.

41. The method of claim 39 wherein the step of placing a sealant in the first housing comprises placing a viscous sealant in the first housing.

42. The method of claim 39 including the step of placing sufficient sealant in the first housing so that when the second housing is brought into engagement therein the sealant in the first housing is forced to flow around the wire connection member to form a waterproof electrical connection therein.

43. The method of claim 39 including the step of stripping a portion of the uncut electrical wire and inserting the stripped portion into the wire connection member.

* * * * *